US008864420B2

(12) United States Patent
Foo et al.

(10) Patent No.: US 8,864,420 B2
(45) Date of Patent: Oct. 21, 2014

(54) OFFSHORE SYSTEMS AND METHODS FOR LIQUEFIED GAS PRODUCTION, STORAGE AND OFFLOADING TO REDUCE AND PREVENT DAMAGE

(75) Inventors: Kok Seng Foo, Singapore (SG); Wen Sin Chong, Singapore (SG); Alex Kah Keong Tan, Singapore (SG); Xiao Xia Sheng, Singapore (SG); Asbjørn Mortensen, Singapore (SG)

(73) Assignee: Keppel Offshore & Marine Technology Centre Pte Ltd, Singapore (SG)

( * ) Notice: Subject to any disclaimer, the term of this patent is extended or adjusted under 35 U.S.C. 154(b) by 170 days.

(21) Appl. No.: 13/407,538

(22) Filed: Feb. 28, 2012

(65) Prior Publication Data

US 2012/0230772 A1 Sep. 13, 2012

Related U.S. Application Data

(60) Provisional application No. 61/451,710, filed on Mar. 11, 2011.

(51) Int. Cl.
*B63B 35/44* (2006.01)
*B63B 27/34* (2006.01)

(52) U.S. Cl.
CPC ..... *B63B 27/34* (2013.01); *B63B 2035/4486* (2013.01)
USPC ..... 405/211; 405/195.1; 405/203; 405/210; 137/615; 441/3; 441/4; 441/5; 414/137.1; 414/137.9; 414/139.6; 141/284; 141/382; 141/387

(58) Field of Classification Search
CPC .. B63B 27/34; B63B 2035/4486; B63B 27/24
USPC ..... 405/195.1, 196, 201, 203, 210, 211; 441/3–5; 114/230.12; 414/137.1, 414/137.9, 139.6; 137/615; 141/284, 382, 141/387
See application file for complete search history.

(56) References Cited

U.S. PATENT DOCUMENTS 3,984,059 A * 10/1976 Davies ..... 141/387
4,538,849 A * 9/1985 Khachaturian et al. ..... 294/81.1

(Continued)

FOREIGN PATENT DOCUMENTS

FR 2 923 453 A1 5/2009
KR 2009 0059550 A 6/2009

(Continued)

OTHER PUBLICATIONS

Communication including extended European Search Report, dated Jan. 2, 2013 by the European Patent Office, in connection with European Patent Application No. 12 15 8595.4, Keppel Offshore &Marine Technology Centre Pte Ltd.

*Primary Examiner* — Sean Andrish
*Assistant Examiner* — Carib Oquendo
(74) *Attorney, Agent, or Firm* — John P. White; Cooper & Dunham LLP

(57) ABSTRACT

Disclosed are systems and methods for limiting structural damage to an affected offshore platform and preventing damage spread from the affected offshore platform to another platform during an accident or an emergency condition. An offshore platform arrangement includes a mobile offshore production unit (MOPU), a mobile storage platform and a mobile offloading platform which are disposed at a clearance distance from one another. The platforms are fluidly connected by pipes to allow hydrocarbon fluid transfer therebetween. The pipes are adapted to cease fluid communication of hydrocarbon fluid between platforms for preventing damage spread therebetween. Also disclosed is an offloading system for hydrocarbon fluid transfer which includes a lifting system having an extendable lifting arm and a spreader frame platform rotatably coupled to the lifting arm. The spreader frame platform is operable to support a transfer skid and allow angular adjustment of the transfer skid in a horizontal plane.

14 Claims, 16 Drawing Sheets

(56) References Cited

U.S. PATENT DOCUMENTS

| | | | | |
|---|---|---|---|---|
| 4,907,912 | A * | 3/1990 | Smith | 405/208 |
| 5,803,779 | A * | 9/1998 | Horton, III | 441/4 |
| 5,885,028 | A * | 3/1999 | Blanchard et al. | 405/210 |
| 6,609,544 | B1 | 8/2003 | Williamson | |
| 6,729,804 | B1 * | 5/2004 | Roodenburg et al. | 405/201 |
| 6,886,611 | B2 | 5/2005 | Dupont et al. | |
| 6,942,427 | B1 * | 9/2005 | Srinivasan | 405/210 |
| 6,976,443 | B2 * | 12/2005 | Oma et al. | 114/144 B |
| 6,997,643 | B2 * | 2/2006 | Wille et al. | 405/53 |
| 7,147,022 | B2 * | 12/2006 | Le Devehat | 141/387 |
| 7,174,930 | B2 * | 2/2007 | Poldervaart et al. | 441/5 |
| 7,290,815 | B1 * | 11/2007 | Whittington | 294/67.4 |
| 2008/0236703 | A1 | 10/2008 | Adkins et al. | |
| 2010/0147398 | A1 | 6/2010 | Thomas et al. | |
| 2010/0279561 | A1 * | 11/2010 | Van Hoeken | 441/5 |
| 2011/0182698 | A1 * | 7/2011 | Foo et al. | 414/137.5 |

FOREIGN PATENT DOCUMENTS

| | | | |
|---|---|---|---|
| WO | WO 01/34460 | A1 | 5/2001 |
| WO | WO 02/22491 | A1 | 3/2002 |
| WO | WO 2010/116489 | A1 | 10/2010 |

* cited by examiner

OFFSHORE SYSTEMS AND METHODS FOR LIQUEFIED GAS PRODUCTION, STORAGE AND OFFLOADING TO REDUCE AND PREVENT DAMAGE

CROSS-REFERENCE TO RELATED APPLICATION

This application claims the benefit of U.S. Provisional Application No. 61/451,710, filed Mar. 11, 2011, the contents of which are hereby incorporated by reference into this application.

BACKGROUND

1. Technical Field

Embodiments of the invention relate generally to offshore systems and methods in liquefied gas production, storage and offloading, and more particularly to limiting structural damage to an affected offshore platform and preventing damage spread from the affected offshore platform to another platform during accidents or emergency conditions, e.g. collision, fire or explosion.

2. Description of Related Art

There has been considerable publicity over accidents at offshore oil or gas platforms. Collision of a vessel with an offshore platform potentially results in damage to structural integrity of the platform and economic losses due to high capital investments in construction of the offshore platform. Fires and explosion blowouts threaten personnel safety and environment well-being. Due to the volume of flammable materials on offshore platforms, fires on offshore platforms are known to burn for long periods of time resulting in severe and possibly irreparable damage to the offshore platforms. Even if fires may be eventually put out, the potential pollution due to oil spills may result in an environmental disaster.

In view of the above and other problems, limiting structural damage to an affected offshore platform and preventing damage spread from the affected offshore platform to another platform are highly desirable.

SUMMARY

Embodiments of the invention relate to systems and methods for limiting structural damage to an affected offshore platform and preventing damage spread from the affected offshore platform to another platform during accidents or emergency conditions, e.g. a fire or an explosion. According to one embodiment of the invention, an offshore platform arrangement may include a mobile storage platform having a storage facility for storing a hydrocarbon fluid, e.g. liquefied natural gas (LNG), a mobile offloading platform disposed at a first clearance distance from the mobile storage platform and having an offloading system for facilitating transfer of hydrocarbon fluid from the storage facility to a carrier vessel which is positioned at the mobile offloading platform; and at least a first pipe connecting the mobile storage platform to the mobile offloading platform for allowing fluid communication of hydrocarbon fluid therebetween, wherein the first pipe is adapted to cease fluid communication of hydrocarbon fluid between the mobile storage platform and the mobile offloading platform.

According to another embodiment of the invention, the offshore platform arrangement may further include a mobile offshore production unit (MOPU) which is disposed at a second clearance distance from the mobile storage platform; and at least a second pipe connecting the mobile offshore production unit to the mobile storage platform for allowing fluid communication of hydrocarbon fluid therebetween, wherein the second pipe is adapted to cease fluid communication of hydrocarbon fluid between the mobile offshore production unit and the mobile storage platform.

According to another embodiment of the invention, an offloading system for facilitating hydrocarbon fluid transfer between a mobile platform and a carrier vessel may include a transfer skid and a lifting system operable to move the transfer skid from the mobile platform to a carrier vessel for installation thereon to provide fluid communication between the mobile platform and the carrier vessel. The lifting system is also operable to return the transfer skid to the mobile offloading platform after an offloading operation. The transfer skid may include a skid frame; a plurality of pipes which are rigidly attached to the skid frame, a plurality of jack screw mechanisms for independently adjusting the pipes relative to the skid frame, each of the pipes having a first end and a second distal end; a coupler provided at the first end of the each of the pipes to connect to the carrier vessel after installing the transfer skid on the carrier vessel; an emergency release coupling provided at the second end of the each of the pipes; and a transfer hose connected between the emergency release coupling and the mobile offloading platform. The lifting system may include an extendable lifting arm; a spreader frame attachment which includes at least a lifting device to support the transfer skid, wherein the spreader frame attachment is rotatably coupled to the lifting arm to allow angular adjustment of the transfer skid in a horizontal plane.

BRIEF DESCRIPTION OF THE DRAWINGS

Embodiments of the invention are disclosed hereinafter with reference to the drawings, in which.

DETAILED DESCRIPTION

Figure 1A:
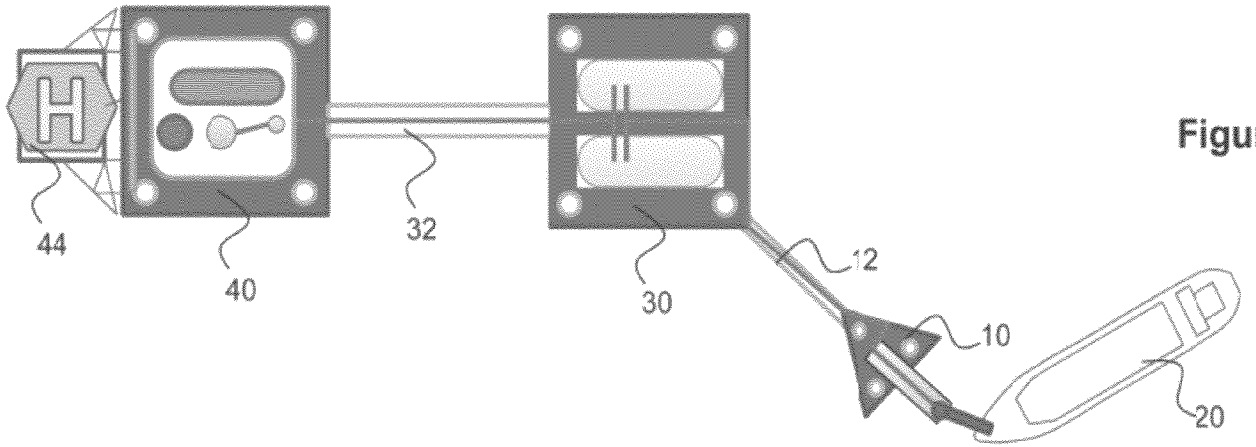
FIG. 1A is a simplified top view of an offshore platform arrangement according to one embodiment of the invention.

In the following description, numerous specific details are set forth in order to provide a thorough understanding of various illustrative embodiments of the invention. It will be understood, however, to one skilled in the art, that embodiments of the invention may be practiced without some or all of these specific details. In other instances, well known process operations have not been described in detail in order not to unnecessarily obscure pertinent aspects of embodiments being described. In the drawings, like reference numerals refer to same or similar functionalities or features throughout the several views.

Figure 1B:
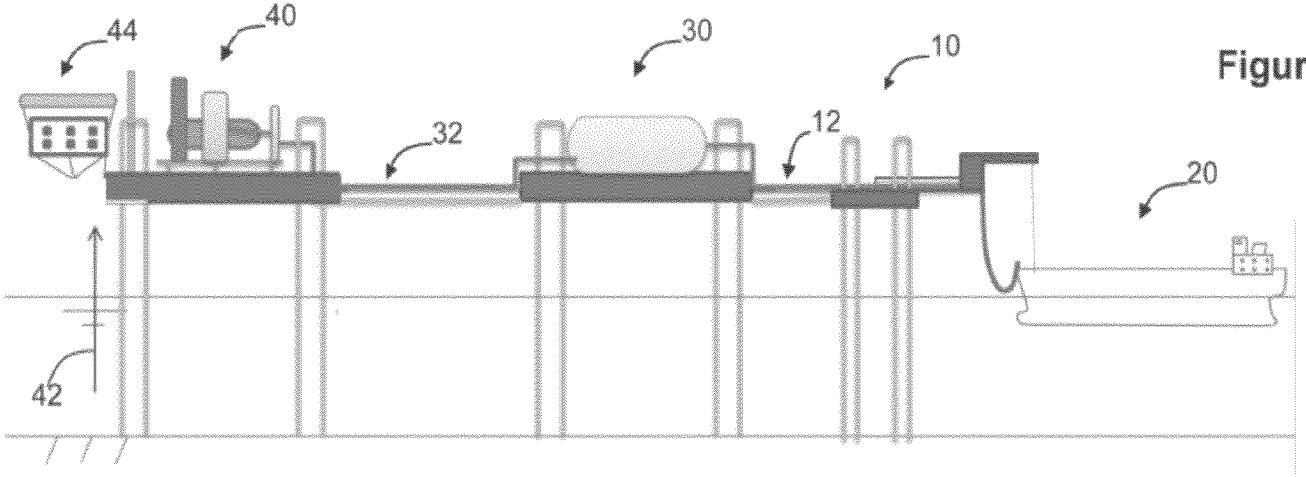
FIG. 1B is a simplified side view of FIG. 1A.

Reference is made to FIGS. 1A and 1B illustrating an offshore platform arrangement according to one embodiment of the invention. As illustrated, an offshore arrangement may include at least one mobile offshore production unit (MOPU) 40 or production platform, at least one mobile storage platform 30 and at least one mobile offloading platform 10. The MOPU 40, mobile storage platform 30 and mobile offloading platform 10 are spaced apart from one another, but are connected by pipes to allow fluid communication for transfer of hydrocarbon fluid from one platform to another.

The MOPU 40 may include a production facility e.g. a liquefaction facility for liquefying gaseous hydrocarbon fluid such as natural gas. The MOPU 40 may be connected by pipelines 42 to at least one oil and/or gas well which supplies the gaseous hydrocarbon fluid and other hydrocarbon products to the MOPU 40. The MOPU 40 may include other facilities, e.g. accommodation facility 44 for personnel.

The mobile storage platform 30 is spaced at a clearance distance from the MOPU 40. The mobile storage platform 30 may include storage tanks for storing hydrocarbon fluid, e.g. liquefied natural gas (LNG), produced from the MOPU 40. One or more pipes 32 connect the MOPU 40 to the mobile storage platform 30 to facilitate transfer of hydrocarbon fluid from the MOPU 40 to the mobile storage platform 30.

The mobile offloading platform 10 is spaced at a clearance distance from the mobile storage platform 30. The mobile offloading platform 10 may include an offloading system as described in subsequent paragraphs and FIGS. 3A to 19. A carrier vessel 20, e.g. Dynamic Positioning (DP) carrier, may be positioned at the mobile offloading platform 10, by means of dynamic positioning system or mooring system, to be loaded with hydrocarbon fluid.

As illustrated, the MOPU 40, mobile storage platform 30 and mobile offloading platform 10 are separated and spaced apart from one another. However, the various platforms may be fluidly connected by a piping bridge or pipes to allow transfer of hydrocarbon fluid from one platform to another. Particularly, at least a first pipe 32 connecting between the MOPU 40 and mobile storage platform 30 allows hydrocarbon fluid to be transferred from the MOPU 40 to the mobile storage platform 30 to be stored. Further, at least a second pipe 12 connecting between the mobile storage platform 30 and mobile offloading platform 10 allows hydrocarbon fluid to be transferred out from storage to be offloaded onto a carrier vessel 20.

The piping bridges or pipes allow fluid communication between each of the MOPU 40, mobile storage platform 30 and mobile offloading platform 10 to be ceased or blocked as and when required. Particularly, the pipes 12, 32 may be provided with block valves or emergency shut-down valves to cease fluid communication between the platforms 10, 30, 40 during an accident or an emergency condition, e.g. collision, fire or explosion. For example, block or shut-down valves may be provided at each end of each pipe and adapted to block fluid flow in the pipes 12, 32 as and when required. A substantial portion of the pipes may be located above the sea level.

Figure 2A:
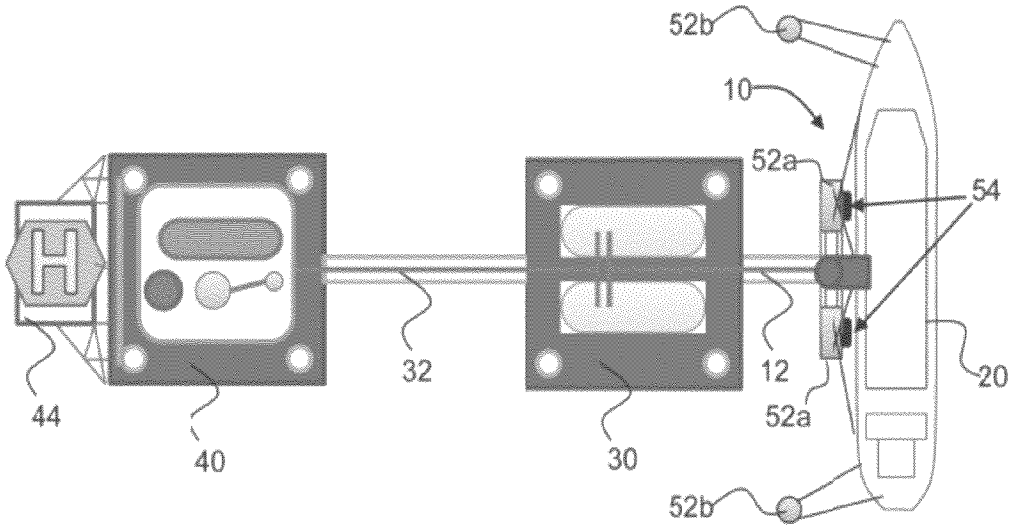
FIG. 2A is a simplified top view of an offshore platform arrangement according to one embodiment of the invention.
Figure 2B:
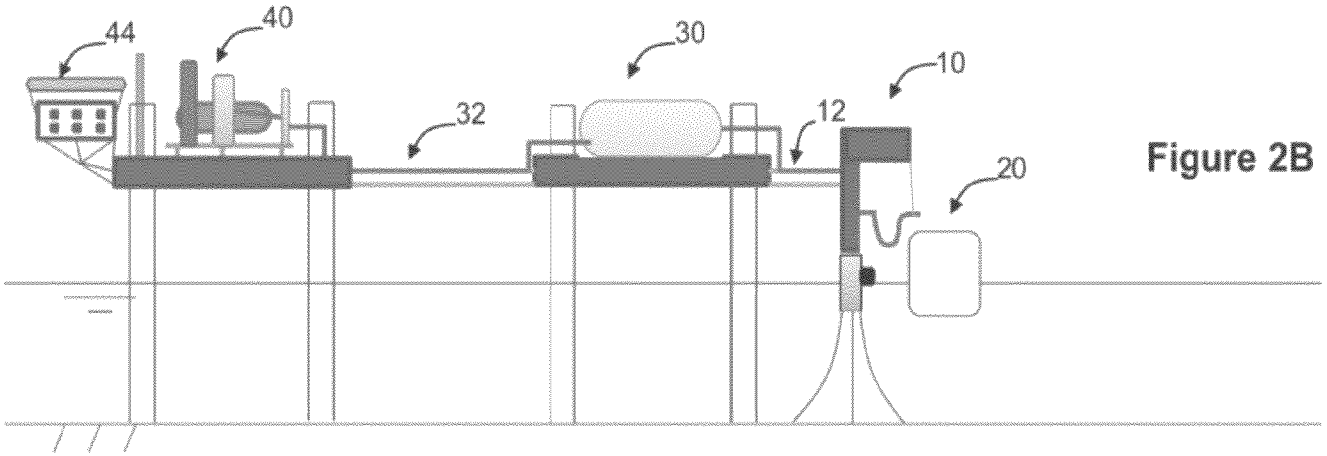
FIG. 2B is a simplified side view of FIG. 2A.
Figure 3A:
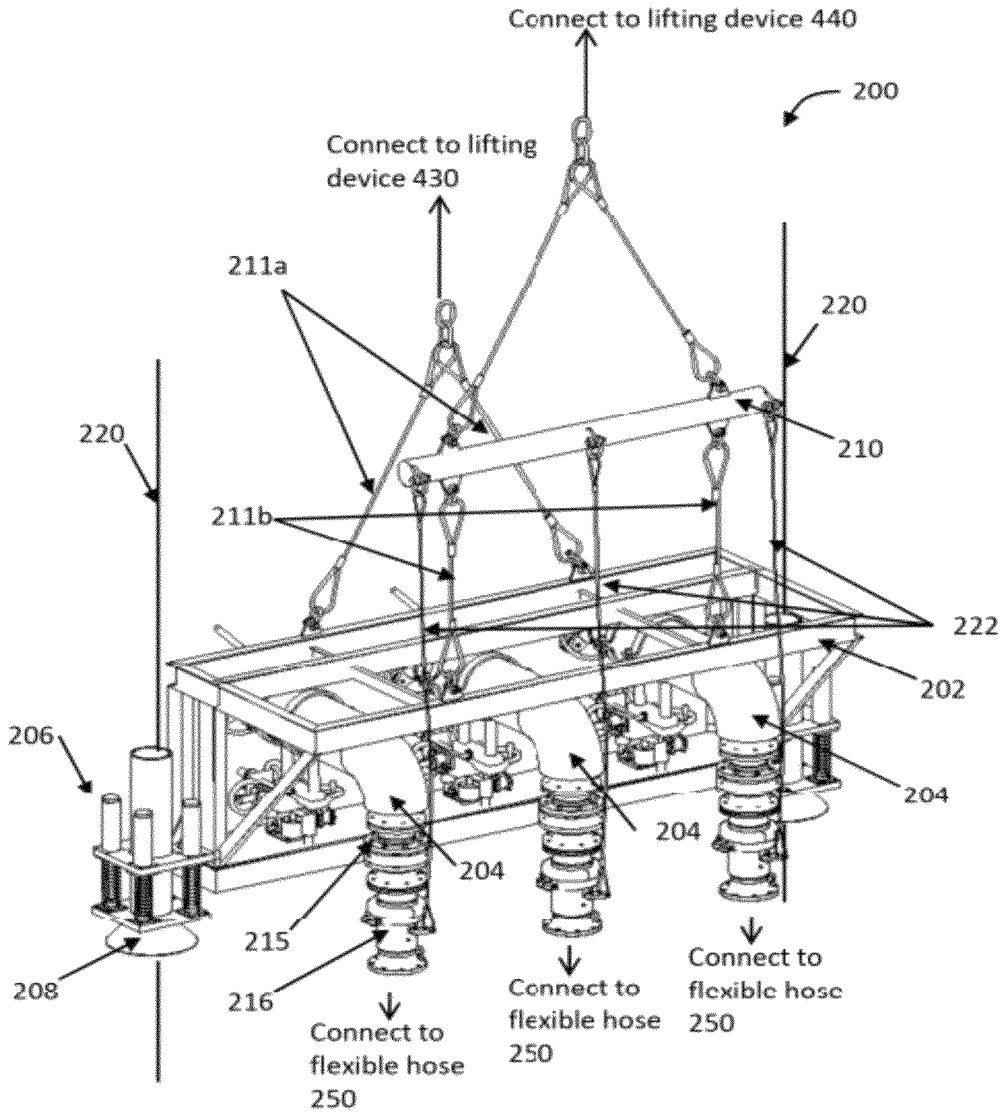
FIG. 3A is a rear view of a transfer skid.
Figure 3B:
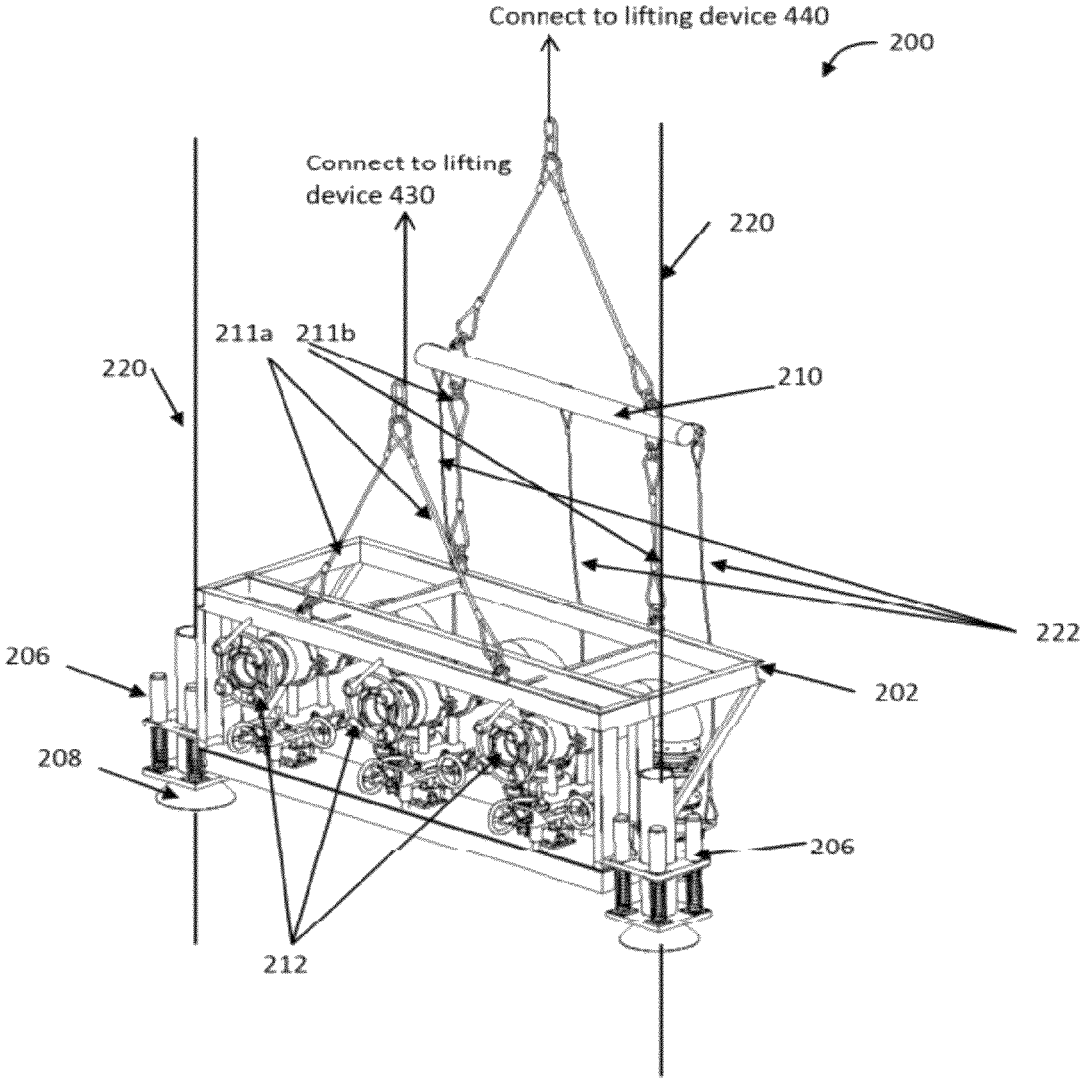
FIG. 3B is a front view of the transfer skid of FIG. 3A.
Figure 3C:
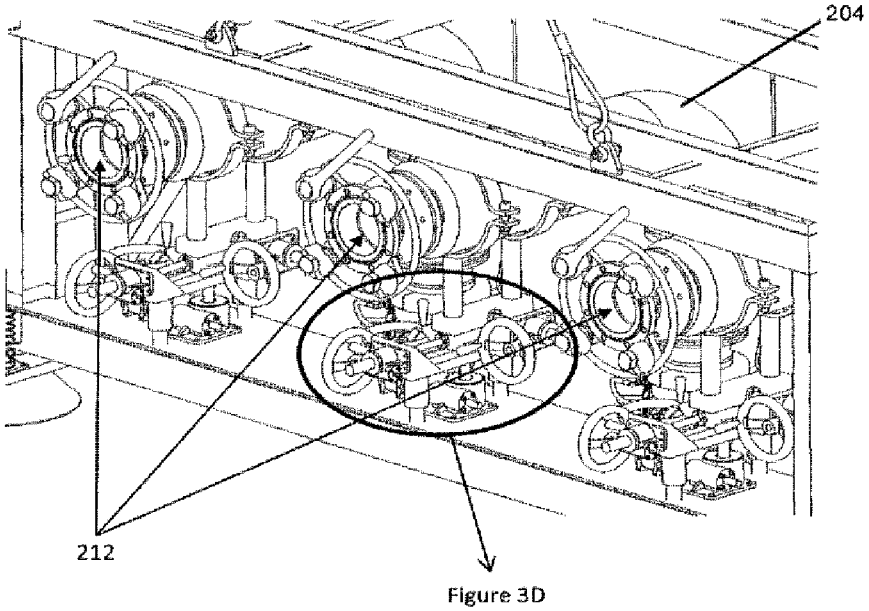
FIG. 3C is a close-up view of the transfer skid of FIG. 3B.
Figure 3D:
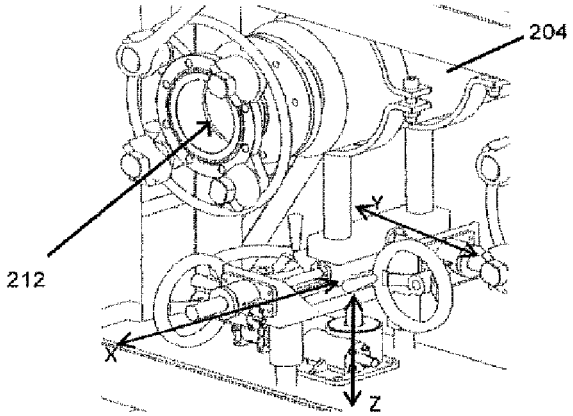
FIG. 3D is a close-up view of a jack screw mechanism of FIG. 3C.

FIGS. 2A and 2B illustrate another offshore platform arrangement according to one embodiment of the invention. The arrangement of FIGS. 2A and 2B is similar to FIGS. 1A and 1B, except for the mobile offloading platform 10 which employs multiple, e.g. four, floating mooring dolphins. As illustrated, two centre dolphins 52*a* may be positioned and attached with fenders 54 each. These two centre dolphins 52*a* may be used to allow berthing of a carrier vessel 20 and to provide a platform for an offloading system. Portside of a carrier vessel 20 will berth along these two centre dolphins 52*a* by assistant tugs or dynamic positioning system installed in the carrier vessel. String mooring lines may be used to connect between these two centre dolphins 52*a* and portside of the carrier vessel 20. The other two dolphins 52*b* are located transversely away from the bow and stern of the carrier vessel 20. Breast mooring lines may be used to connect bow and stern of the carrier vessel 20 to the corresponding dolphin. Man-walking bridges may be installed to link all these four dolphins to allow personnel or operators to access the four dolphins. The arrangement of FIGS. 2A and 2B are suitable for berthing carrier vessel 20 with or without Dynamic Positioning.

Although FIGS. 1A and 1B, 2A and 2B illustrate a MOPU 40, a mobile storage platform 30 and a mobile offloading platform 10, it is to be appreciated that multiple units of the MOPU 40, mobile storage platform 30 and mobile offloading platform 10 may be provided in other embodiments and arranged to allow fluid communication between platforms as described in the foregoing.

Also, although FIGS. 1A and 1B, 2A and 2B illustrate separate platforms for production and storage facilities, it is to be appreciated that production and storage facilities may be provided on a same platform in certain embodiments. In this case, an offshore arrangement may include a single mobile platform that provides both a production facility and a storage facility, and a spaced apart mobile offloading platform which is connected to the single mobile platform by one or more pipes.

As safety and space efficiency are of paramount concern in the offshore industry, the arrangements of FIGS. 1A and 1B, 2A and 2B achieve various advantages such as but not limited to the following:

(1) Arrangement of production, storage and offloading facilities on separate platforms increases safety as compared to combining these facilities on a single platform. Hydrocarbon fluid communication between various platforms may be quickly blocked during emergency conditions by shutting down piping bridges to cease hydrocarbon fluid flow between the platforms. This way, if a collision occurs which may break the piping bridges, the risk of a hydrocarbon fluid spill is minimized once hydrocarbon fluid flow is blocked between platforms. Also, the risk of a fire or explosion spread is also minimized with the blockage of hydrocarbon fluid flow between platforms.

(2) Providing a mobile offloading platform as a separate platform from production and storage facilities also serves as a barrier to protect the production and storage facilities from collision risk by a carrier vessel. Since a carrier vessel is positioned at the mobile offloading platform, the potential risk of the carrier vessel colliding with the mobile offloading platform is significantly higher than with the production or storage platforms which are located further and separated from the mobile offloading platform. Hence, if a collision does occur, the damage to the mobile offloading platform results in much lower economic losses than if a collision occurs at a platform which houses production, storage and offloading facilities.

(3) As offshore platforms, e.g. MOPU, are fixed bodies which are not affected by wave motion, onshore technology and process equipment for production and storage may be easily adapted.

(4) The use of mobile platforms allows for relocation of the production and storage facilities without the need for expensive installation and uninstallation of fixed offshore platforms. If the production capacity of an oil or gas field needs to be increased, mobile production and storage platforms may be installed more quickly as compared to employing fixed offshore platforms. Hence, production, storage and offloading facilities can be added over a large offshore area at lower capital investments. Separately, if an oil or gas field approaches depletion, the mobile platforms may be more easily redeployed to other locations.

Reference is now made to FIGS. 3A to 18 which illustrate an apparatus and methods for offloading or transferring a hydrocarbon fluid, e.g. liquefied natural gas (LNG) and liquefied petroleum gas (LPG), between a fixed body or structure, e.g. jack-up platform, jacket, self-installing platform, Mobile Offshore Production Unit (MOPU) and a mobile platform, and a moving body, e.g. a carrier vessel. Before an offloading operation takes place, a transfer skid has to connect the two bodies to allow fluid communication therebetween. Moving the transfer skid from a fixed body to a moving body poses a challenge especially in harsh sea conditions as excessive wave-induced or weather-induced motions in the moving body may result in collision with the fixed body.

FIGS. 3A to 3D illustrate various views of a transfer skid 200 according to one embodiment of the invention. The transfer skid 200 includes a skid frame 202 for supporting a plurality of pipes 204. In the embodiment of FIGS. 3A to 3D, the skid frame 202 includes three pipes 204, where two pipes may be used for hydrocarbon fluid transfer and one pipe may be used for vapour return. It is to be appreciated that other configurations of the transfer skid 200 with other number of pipes 204 (e.g. two, three, or more) may be used with suitable modifications. Each pipe 204 may have an L-shape and is provided with insulation. At a first end of each pipe, a Quick Connect/Disconnect Coupler 212 (QCDC) is provided to connect to a manifold flange on a carrier vessel 20. While QCDCs 212 are presently illustrated and described, it is to be appreciated that other forms of couplers, whether a manual device e.g. bolted connection, or an automatic device, used to connect the transfer skid 200 to manifolds on the carrier vessel 20, may be used in certain other embodiments. At a second (distal) end of each pipe 204, an Emergency Release Coupling (ERC) 216 is provided to connect to a cryogenic transfer hose 250 which is flexible. In certain embodiments, the ERC 216 may have a dual-function, i.e. it can also function as a double block valve. Particularly, each of mating connectors 216*a*, 216*b* of the ERC 216 includes a valve which is capable of shutting or closing without detaching from each other; the valve is also capable of shutting or closing, and thereafter detach from each other. In certain other embodiments, separate double block valves may be provided in the pipes 204. A swivel 215 (optional) may be interposed or connected between the ERC 216 and the second end of each pipe 204 to allow rotational movement of the transfer skid 200 relative to the carrier vessel 20 after the transfer skid 200 is installed on the carrier vessel 20.

The pipes 204 may be rigidly attached to the skid frame 202 to prevent load unbalance and swaying movements due to wind. However, jack screws may be provided at each pipe 204 to allow independent adjustment of each pipe 204 relative to the skid frame 202 in one or more directions, e.g. x, y and z directions (see FIGS. 3C and 3D). Hence, each pipe 204 can be manipulated or repositioned independently of other pipes 204 to ensure improved mating of a pipe 204 with a manifold flange on a carrier vessel even if various flanges on the carrier vessel are unevenly located due to uneven deck or for other reasons. In certain embodiments, jack screws of the various pipes 204 may be connected or coupled together to allow simultaneous adjustment of two or more pipes 204. In certain other embodiments, other adjustment mechanisms, e.g. gears, chains, belts, may be used in place of jack screws.

The ERC 216 may be formed of a pair of mating parts or connectors (hereinafter ERC1 216*a* and ERC2 216*b* respectively) which are normally securely engaged to each other when the transfer skid 200 is disposed in a parked position and during offloading operation. The mating parts may be activated to disconnect from each other within a predetermined time during an emergency release operation. ERC1 216*a* connects to a transfer or flexible hose 250 which is to connect, directly or via other connectors or pipes 204, to a mobile offloading platform 10. ERC2 216*b* is interposed or connected between ERC1 216*a* and the pipe 204, directly or indirectly through a swivel 215. A slack ERC hoist sling 222 attaches each ERC1 216*a* to a common spreader beam 210.

At two ends of the skid frame 202, shock absorbers or hydraulic dampeners 206 and guide funnels 208 may be provided. The shock absorbers 206 are constructed and arranged to dampen impact on the transfer skid 200 upon landing of the guide funnels 208 during installation of the transfer skid 200 on a carrier vessel. The guide funnels 208 are constructed and arranged to guide the transfer skid 200, in cooperation with guide wires 220, to a desired position during installation.

The skid frame 202 may have opposed sides which are supported by lifting devices or winches which may be capable of exerting independent control. Particularly, one side of the skid frame 202, which is proximate to the QC/DCs 212, may be supported by hoist wires 211*a* which are in turn supported by a first lifting device 430 (see FIGS. 3A and 3B). The opposed side of the skid frame 202, which is proximate to the ERCs 216, may be supported by hoist wires 211*b* which is supported by a spreader beam 210 which in turn is supported by a second lifting device 440 (see FIGS. 3A and 3B). When the transfer skid 200 is lifted, the skid frame 202 may potentially tilt due to varying loads of transfer hoses 250 resulting from varying heights as the transfer skid 200 is lifted or lowered. To prevent tilting of the skid frame 202, the lifting devices 430, 440 may independently adjust hoist wires 211*a*, 211*b* to position the skid frame 202 at a desired orientation.

Quick release connectors may be provided at the hoist wires 211*a*, 211*b* to allow disconnection of the transfer skid 200 from the spreader beam 210 and lifting devices.

As would be appreciated from the above, the functions of the transfer skid 200 include, but are not limited to, providing a connection interface for hydrocarbon fluid transfer between two bodies 10, 20 and allowing simultaneous transfer of multiple transfer hoses 250 with a single lift.

Figure 4A:
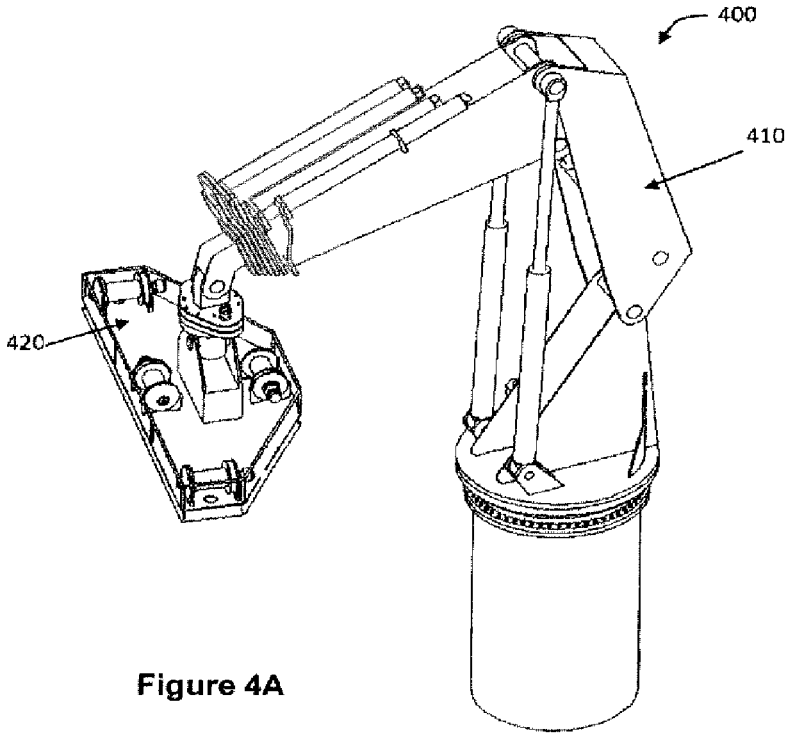
FIG. 4A illustrates a lifting system according to one embodiment of the invention.
Figure 4B:
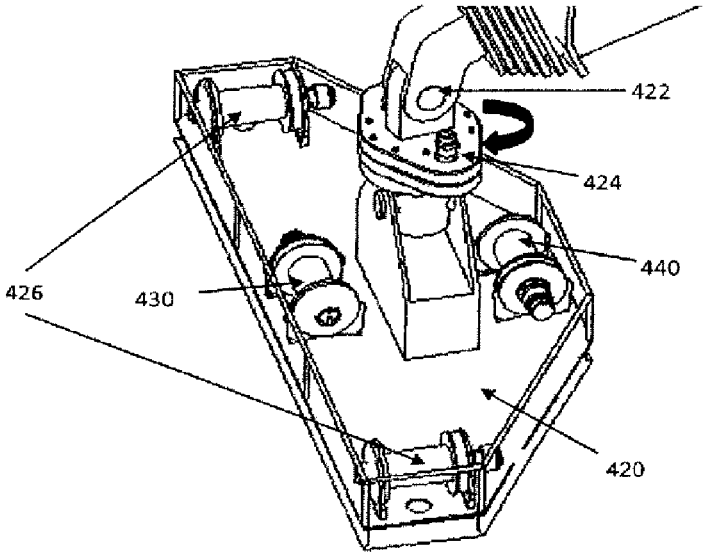
FIG. 4B is a close-up view of a spreader frame of the lifting system of FIG. 4A.

Reference is now made to FIGS. 4A and 4B which illustrate a lifting system 400 which comprises a crane 410, e.g. knuckle boom telescopic crane, and a spreader frame attachment 420 removably coupled to a tip of the crane arm such as by a removable pin 422. The spreader frame attachment 420 includes a powered rotator 424 or swivel which allows the spreader frame attachment 420 to rotate about the tip of the crane arm. The spreader frame attachment 420 also includes lifting devices, e.g. winches 426 for controlling guide wires 220 and winches for providing the lifting devices 430, 440 which support the transfer skid 200. The lifting system 400 allows improved manipulation of the transfer skid 200. Particularly, the telescopic crane arm is extendable towards a desired destination to position the spreader frame attachment 420 thereon. Since the spreader frame attachment 420 is rotatable relative to the tip of the crane arm, the spreader frame attachment 420 allows the transfer skid 200 to be angularly or rotationally adjusted in a horizontal plane. As a person skilled in the art would appreciate, it may not be possible to position a carrier vessel 20 in parallel with the mobile offloading platform 10 due to environmental conditions, and therefore an angular displacement between the carrier vessel 10 and the mobile offshore platform 10 is likely. Hence, the ability of the spreader frame attachment 420 to angularly or rotationally adjust the transfer skid 200 is particularly advantageous during installation when the transfer skid 200 is positioned on a carrier vessel 20 to align to a pipe deck 500 on the carrier vessel 20 and during retrieval of the transfer skid 200 after an offloading operation.

Figure 5:
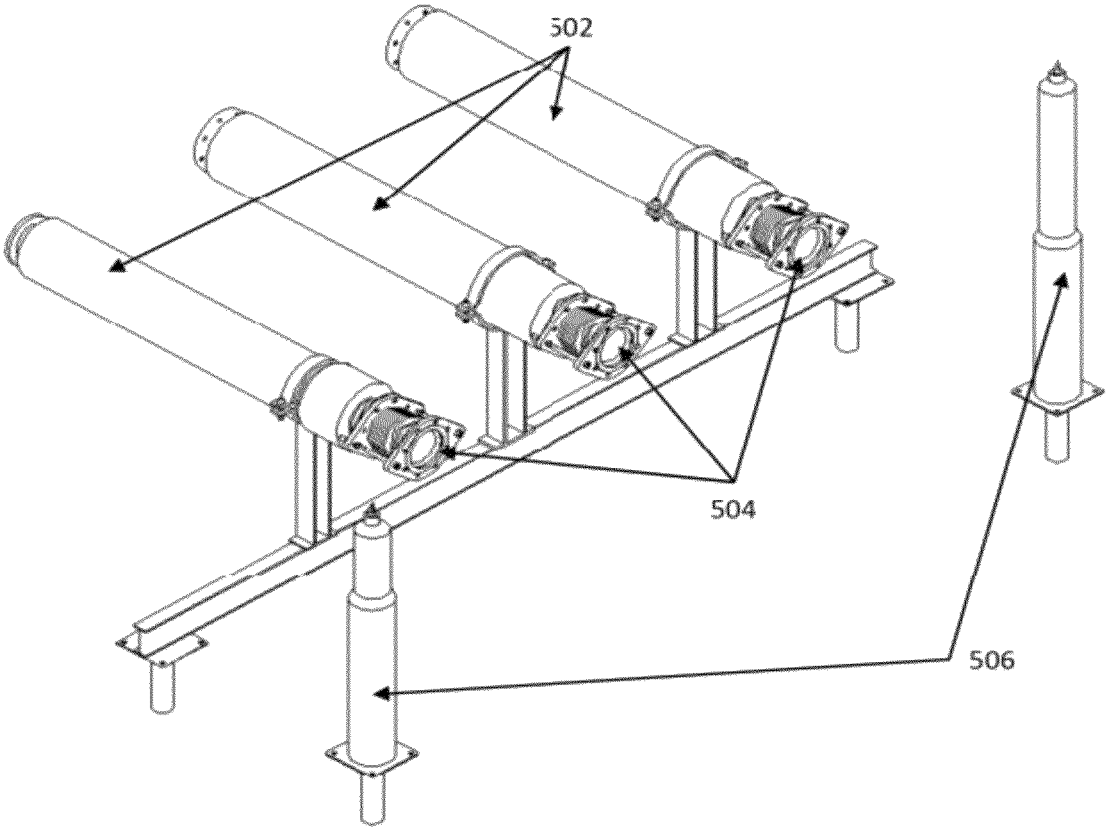
FIG. 5 illustrates a pipe deck.

FIG. 5 illustrates a pipe deck 500 or spool piece that can be removably connected to the manifolds of a carrier vessel 20. It is to be appreciated that manifolds are ducts for facilitating hydrocarbon fluid transfer to and from the carrier vessel 20. The manifolds may be located at a bow portion, a stern portion, a starboard side or a portside of a carrier vessel 20. As the pipe deck 500 contains pipe extensions 502 each terminating at a flange, connecting the pipe deck 500 to manifolds of the carrier vessel 20 effectively moves the position of the manifold flanges towards an outer edge of the carrier vessel 20. At each flange of the pipe extensions 502, a flexible expansion joint 504 is provided which is adapted to connect to a pipe 204 of the transfer skid 200. The flexible expansion joint 504 may be deflected in lateral, axial and angular directions relative to the pipe extension 502 to compensate for slight misalignment between the pipes 204 of the transfer skid 200 and flanges of the flexible expansion joint 504 prior to connection. Further, the pipe extensions 502 may be provided as straight-line pipes. Further, the pipe deck 500 may also be provided with guide posts 506 for receiving funnels 208 therein to guide the transfer skid 200 as it lands onto carrier vessel 20.

Figure 6A:
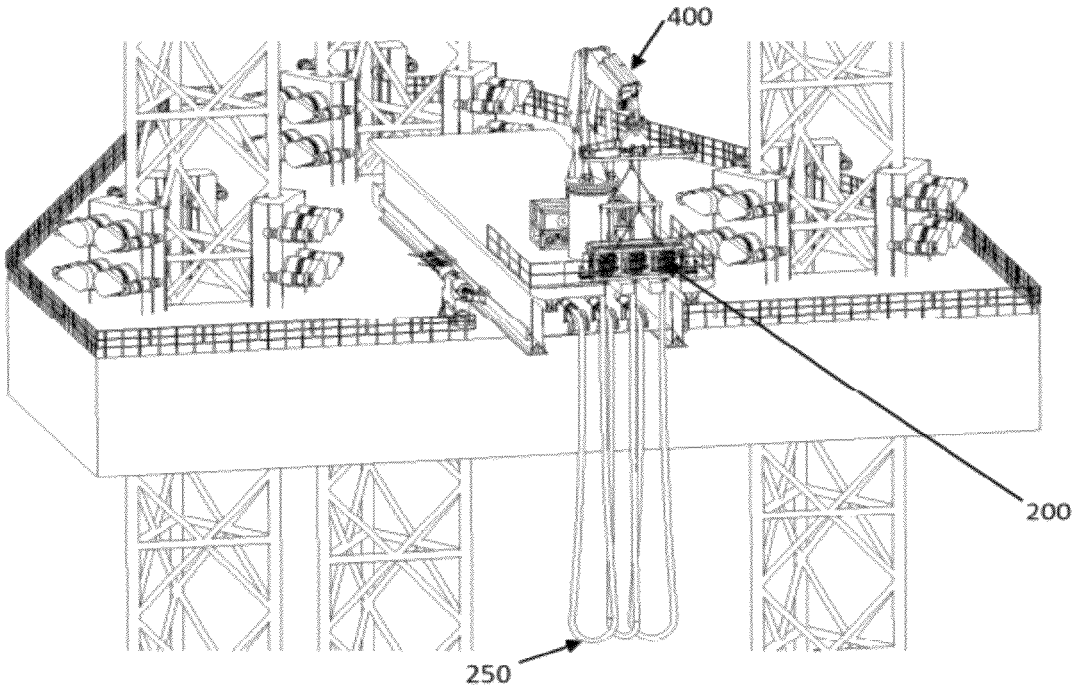
FIG. 6A illustrates an offloading system disposed in a parked position at a mobile offloading platform.
Figure 6B:
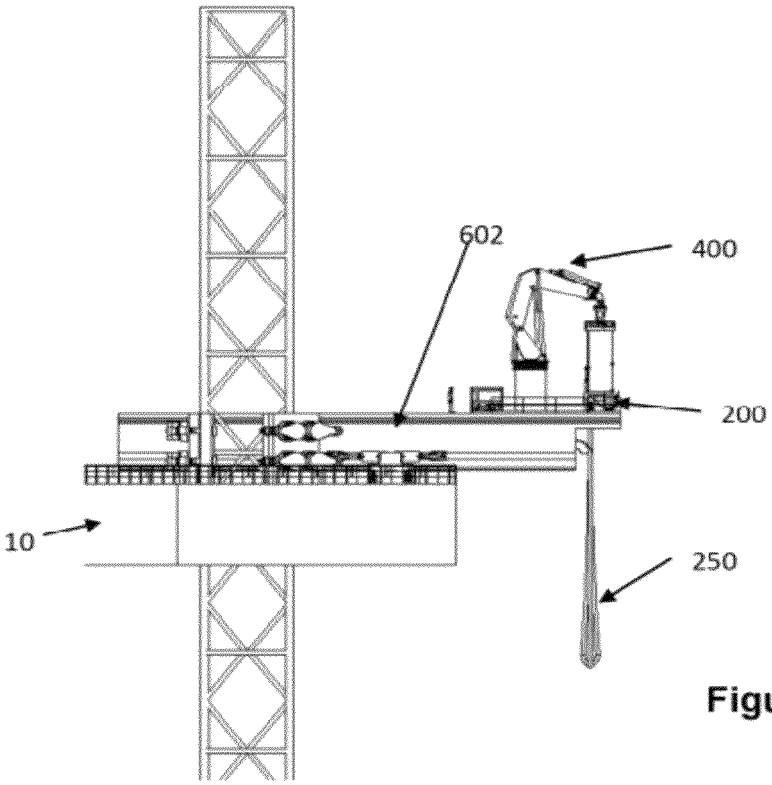
FIG. 6B is a simplified side view of FIG. 6A.

FIGS. 6A and 6B illustrate an offloading system disposed in a parked position at a mobile offloading platform 10. The offloading system may include, a lifting system 400, a transfer skid 200, at least one flexible pipe or hose 250, lifting or hoisting systems.

The mobile offloading platform 10, as illustrated, has at least a deck supported by jack-up legs which are jacked down or installed into the sea floor. An extendable structure, e.g. a cantilever 602 is provided on the deck of the mobile offloading platform 10. The cantilever 602 is arranged to be movable relative to the deck such as by skidding movements. The cantilever 602 may be arranged to move along one or more linear directions (e.g. x and y directions) in a horizontal plane (e.g. over a deck of the mobile offloading platform), or in a pivotal or rotational direction (e.g. pivot about one end of the cantilever 602) in a horizontal plane, or both. The cantilever 602 is arranged to move between a fully retracted position and a fully extended position and various intermediate positions therebetween. In a retracted position, the cantilever 602 may be largely disposed over the deck. In an extended position, the cantilever 602 projects outward from the deck and over the sea. This way, an adjustable horizontal clearance distance from the edge of the deck is created. This outward projection from the deck and over the sea, due to the extended cantilever 602, creates an adjustable horizontal clearance distance from the edge of the deck and jack-up legs to allow safe clearance distance conditions between the mobile offloading platform 10 and a carrier vessel 20 to prevent collision. Further, since the telescopic crane arm of the lifting system 400 is extendable, the crane arm is capable of creating an additional adjustable horizontal clearance distance from the edge of the deck and jack-up legs to allow safe clearance distance conditions between the mobile offloading platform 10 and a carrier vessel 20.

The lifting system 400 as described with reference to FIGS. 4A and 4B may be disposed on the cantilever 602 or at an elevation from the cantilever 602. The lifting system 400 may be disposed at one end of the cantilever 602 which is projectable from the deck in an extended position, and the spreader beam 210 may be rested on the skid frame 202.

Preparation for Offloading Operation, and Offloading Operation

Figure 7A:
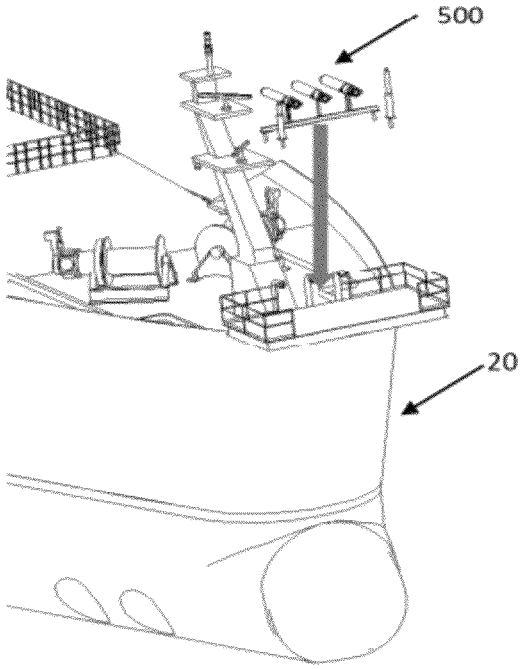
FIG. 7A illustrates a pipe deck lowered onto a carrier vessel.
Figure 7B:
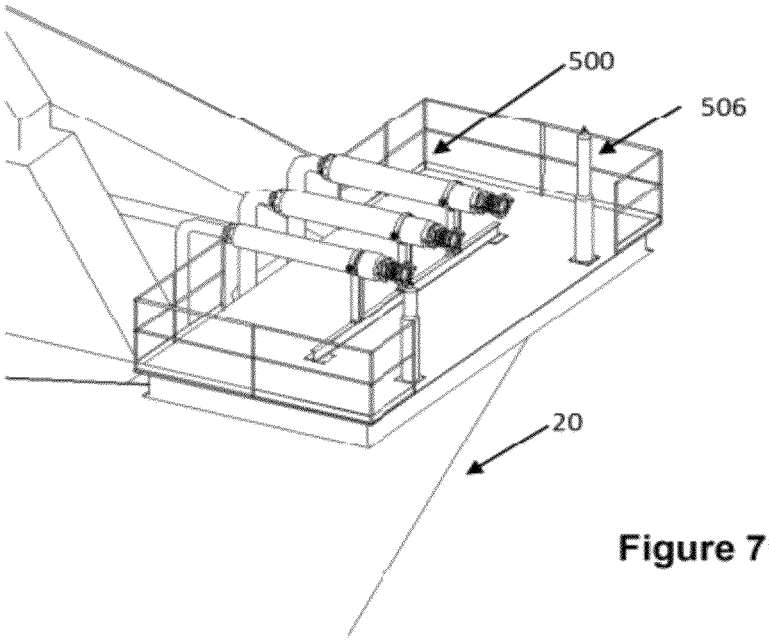
FIG. 7B illustrates a pipe deck installed at the manifolds of the carrier vessel.

FIGS. 7A and 7B illustrate installation of a pipe deck 500 on a carrier vessel 20. In particular, FIG. 7A illustrates a pipe deck 500 being lowered onto a deck of a carrier vessel 20; FIG. 7B illustrates pipe extensions 502 of the pipe deck 500 connected to the manifolds of the carrier vessel 20. Installation of a pipe deck 500 on a carrier vessel 20 may be carried out prior to each hydrocarbon fluid transfer operation. Alternatively, the pipe deck 500 may remain installed on the carrier vessel 20 in between hydrocarbon fluid transfer operations if, for example, the carrier vessel 20 is on a long term charter.

The pipe deck 500 may be installed at a deck level of the carrier vessel 20 so that the pipe deck 500 is accessible to personnel without having to operate at heights.

Figure 8A:
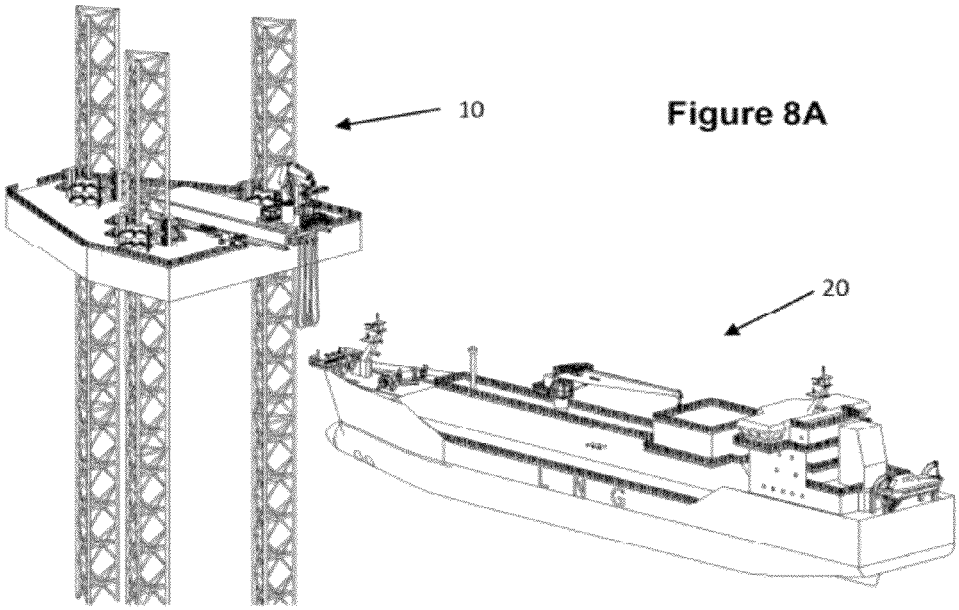
FIG. 8A illustrates a carrier vessel approaching a mobile offloading platform.
Figure 8B:
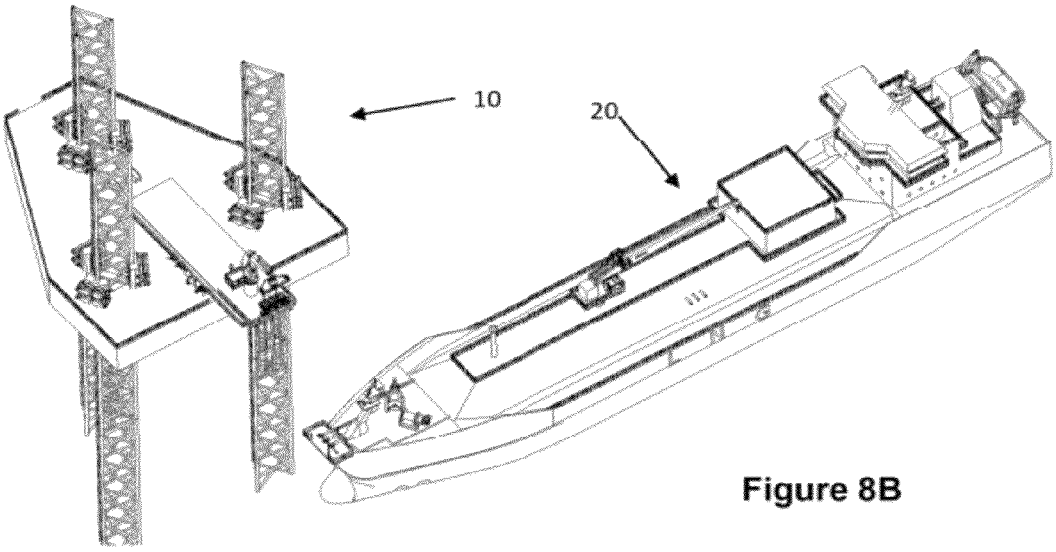
FIG. 8B illustrates an alternative carrier vessel arrangement relative to the mobile offloading platform.

A sequence for connecting a transfer skid 200 to a carrier vessel 20 in preparation for offloading operation is described with reference to FIGS. 8A to 16. FIG. 8A illustrates a carrier vessel 20 approaching a mobile offloading platform 10. The carrier vessel 20 may be separated by a safe distance from the mobile offloading platform 10, particularly from the legs of the mobile offloading platform, to avoid collision. After the carrier vessel 20 is positioned and depending on operator requirement and preference, weather and environment conditions may be monitored to ensure that an offloading operation may commence safely. FIG. 8B illustrates an alternative carrier vessel arrangement relative to the mobile offloading platform.

Figure 9:
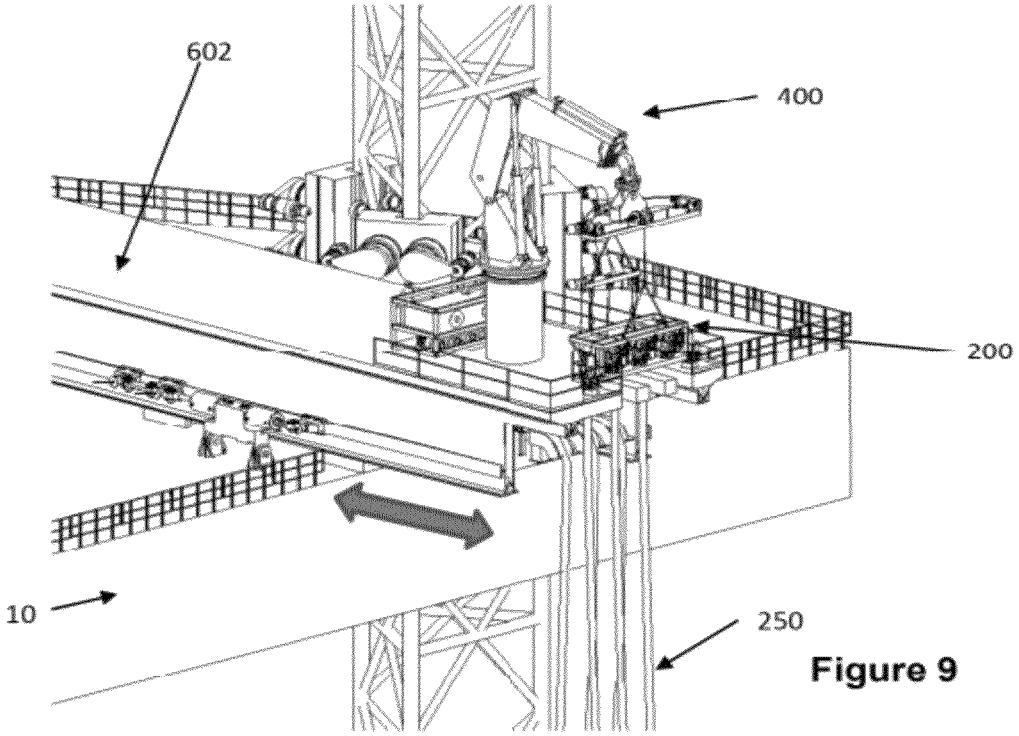
FIG. 9 shows a cantilever 602 in an extended position.
Figure 10:
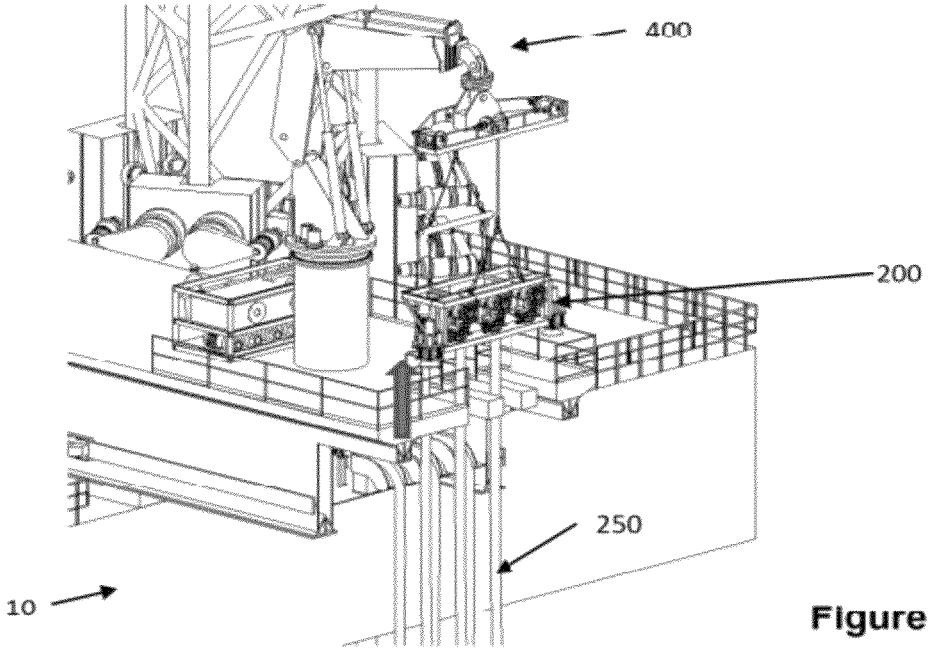
FIG. 10 illustrates a transfer skid lifted from its parking platform.
Figure 11:
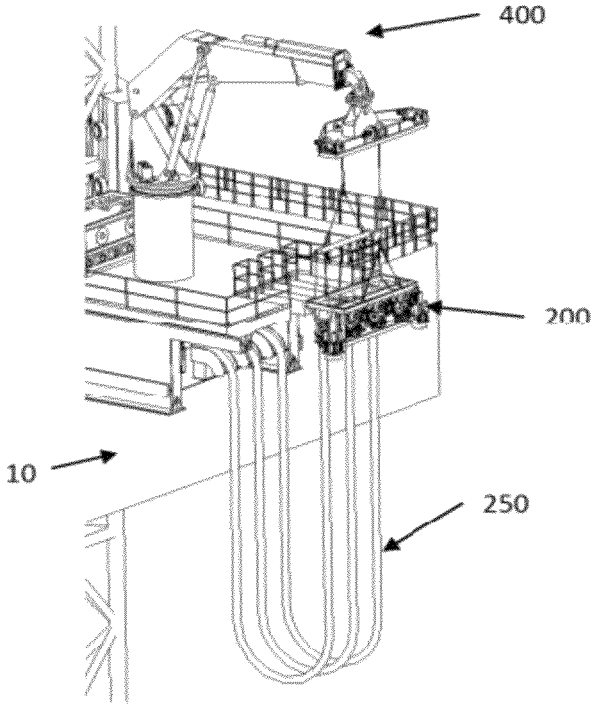
FIG. 11 illustrates a transfer skid being moved towards a carrier vessel.

FIG. 9 shows the cantilever 602 being moved into an extended position, i.e. projected outwards in a horizontal direction from a deck of the mobile offloading platform 10 towards the carrier vessel 20. Since the lifting system, transfer skid and transfer hoses are located at the projected end of the cantilever 602, these components are accordingly projected outward from the deck of the mobile offloading platform 10 and towards the carrier vessel 20.

The sequence proceeds to move or load the transfer skid 200 onto the carrier vessel 20. The lifting system 400 lifts the transfer skid 200 and the spreader beam 210 from the cantilever 602 (see FIG. 10). The lifting system 400 supporting the transfer skid 200 and spreader beam may be extended towards the carrier vessel 20 to position the transfer skid 200 over the pipe deck 500 on the carrier vessel 20 (see FIG. 11).

Figure 12:
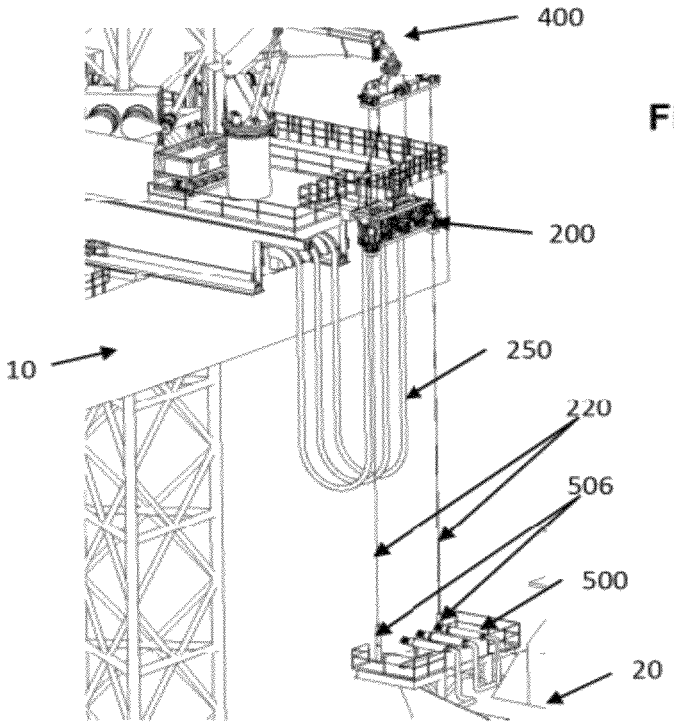
FIG. 12 illustrates guide wires connected to guide posts on a carrier vessel.
Figure 13:
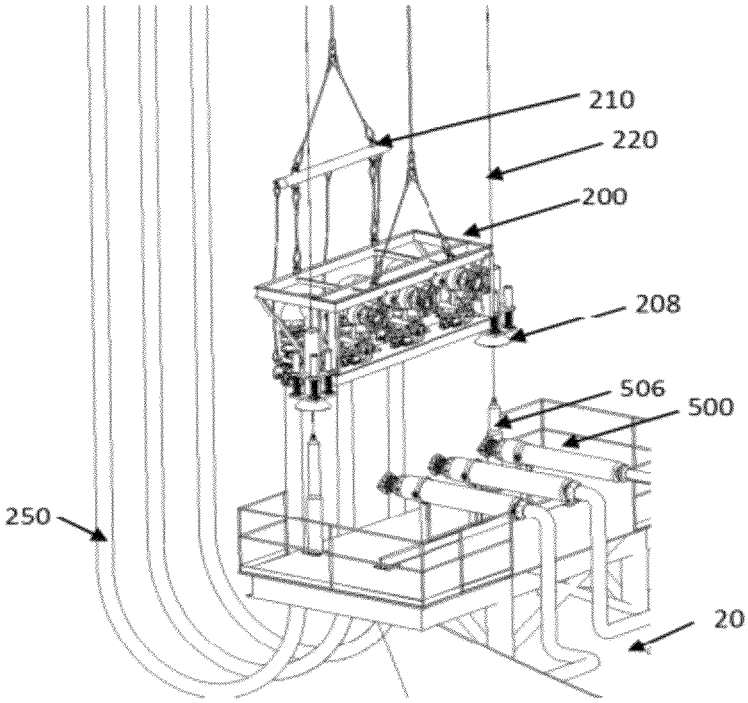
FIG. 13 illustrates a transfer skid being guided to land on a carrier vessel using guide funnels and guide posts.

After the transfer skid 200 is appropriately positioned as desired, guide wires 220, which pass through funnels 208 of the transfer skid 200, may be reeled out from guide winches 426 and connected to guide posts 506 on the carrier vessel 20 (see FIG. 12). As the sea state may create a relative motion between the carrier vessel 20 and the mobile offloading platform 10; the guide wires 220 act as a guide to direct the funnels 208 of the transfer skid 200 towards the guide posts 506. Once the guide wires 220 are secured to the guide posts 506 on the carrier vessel 20, the guide winches 426 maintain a constant tension in the guide wires 220. The transfer skid 200 may then be lowered towards the pipe deck 500 where the guide posts 506 will be inserted into the respective funnels 208 (see FIG. 13), thereby guiding the transfer skid 200 for landing onto the carrier vessel 20 with improved positioning relative to the pipe deck 500.

The transfer skid 200 is then landed onto the carrier vessel 20. During landing, funnels 208 of the transfer skid 200 may collide with the deck of the carrier vessel 20 (see FIG. 14). The collision impact from landing of the transfer skid 200 may be significantly reduced by the shock absorbers 206 disposed at both sides of the funnels 208 of the transfer skid 200. This would prevent both the transfer skid 200 and pipe deck 500 from being damaged by impact shock during landing due to sudden relative heave motion between the carrier vessel 20 and the mobile offloading platform 10. The shock absorbers 206 also reduce impact on the transfer skid 200 when the guide posts 506 are directed into the funnels 208.

Figure 14:
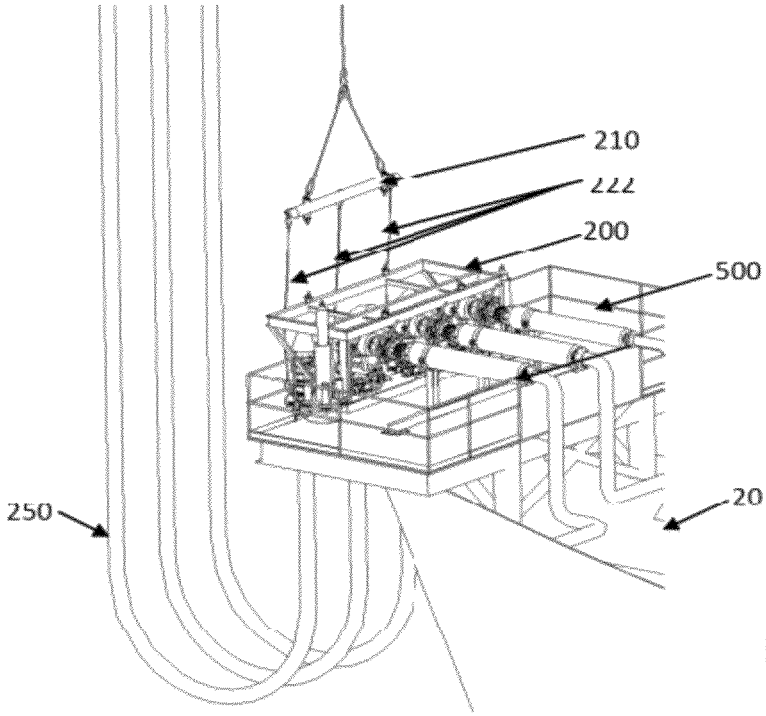
FIG. 14 illustrates a transfer skid frame disconnected from a lifting system.
Figure 15:
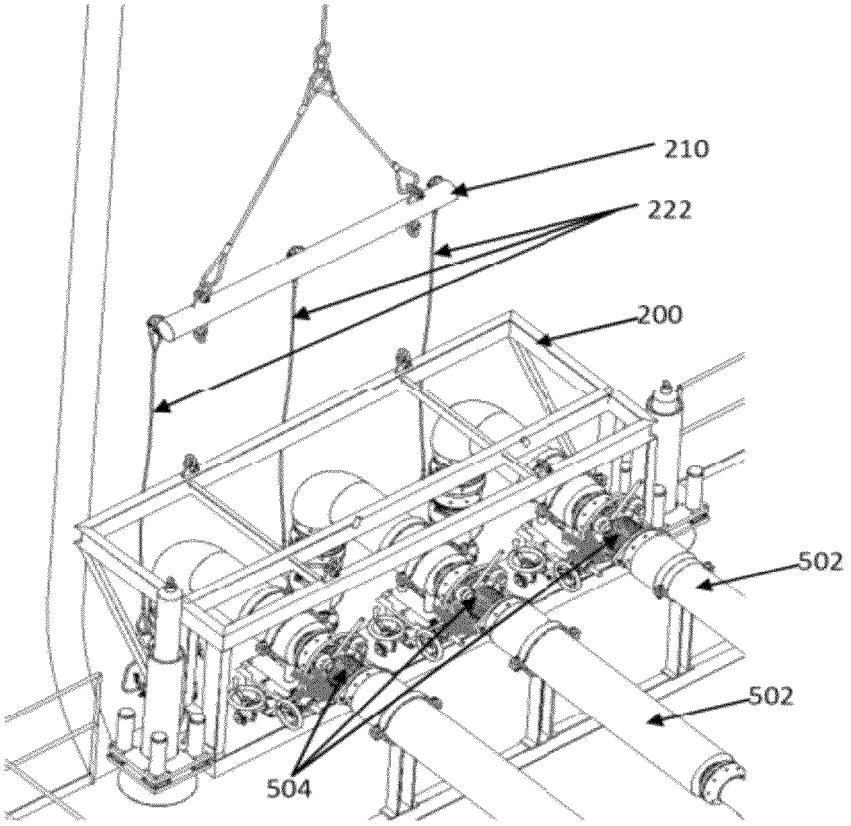
FIG. 15 illustrates a transfer skid connected to a pipe deck of a carrier vessel.

At this stage, the hoist wires 211*a*, 211*b* supporting the transfer skid 200 may be disconnected from the lifting system 400 (see FIG. 14). Particularly, hoist wires 211*a* are disconnected from the first lifting device 430 while hoist wires 211*b* are disconnected from the spreader beam 210. However, the ERCs 216 remain connected to the spreader beam 210 by ERC hoist sling 222, and the spreader beam 210 remains connected to and supported by a second lifting device 440 of the lifting system 400.

Although the transfer skid 200 is landed onto the carrier vessel 20, there may exist gaps between the QCDCs 212 of the transfer skid 200 and the flanges of the flexible expansion joint 504. Adjustments to the alignment of the QCDCs 212 to engage with the flanges of the flexible expansion joints 504 may be performed by jack screw mechanisms provided in the transfer skid 200. Particularly, jack screw mechanism of each pipe 204 of the transfer skid 200 may be controlled to move the pipe 204 in vertical, horizontal and/or transverse directions. Thereafter, fine adjustments to the alignment of the QCDCs 212 to engage with the flanges of the flexible expansion joints 504 may be compensated by the flexible expansion joints 504 provided at the pipe extensions (see FIG. 15). After the QCDCs 212 are aligned with the connecting flanges, cam locks of the QCDCs 212 may be activated to lock or secure the QCDCs 212 to the flanges of the flexible expansion joints 504.

At this stage, the transfer skid 200 is installed at the carrier vessel 20 and is ready to commence an offloading operation. The QCDCs 212 are disposed inboard the carrier vessel 20, e.g. above the main deck of the carrier vessel 20, while the ERCs 216 are disposed outboard of the carrier vessel 20, e.g. exterior of the carrier vessel 20 and over the sea. This is possible as each QCDC 212 is spaced apart from an ERC 216 by a pipe 204 interposed or connected therebetween.

Figure 16:
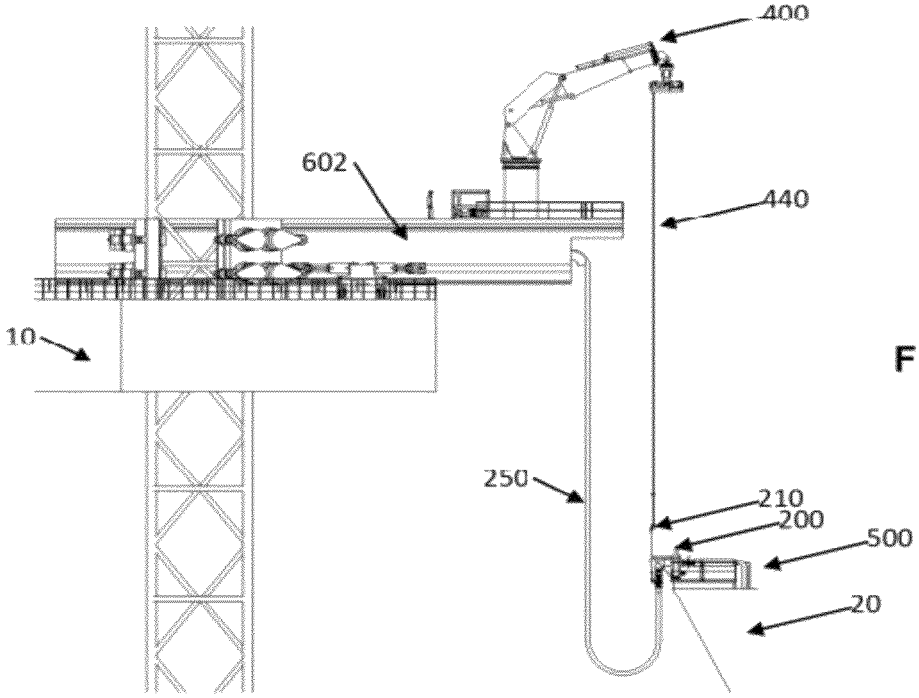
FIG. 16 illustrates an offloading arrangement.

Before commencing an offloading operation, the lifting system 400 may retract and the ERC hoist slings 222 connected to the spreader beam 210 may be allowed to slack (see FIG. 16). Other checks and procedures may take place as required. Offloading operation may then take place in which hydrocarbon fluid, e.g. liquefied natural gas (LNG), may be transferred from the mobile offloading platform 10 to the carrier vessel 20, or vice versa, by way of transfer pumps. Hydrocarbon fluid is transferred from the mobile offloading platform 10 to the carrier vessel 20 via the transfer hoses 250, pipes 204 of the transfer skid 200 and pipe extensions 502 installed on the carrier vessel 20. In one embodiment, two transfer hoses 250 are configured for hydrocarbon fluid transfer while the remaining hose 250 is configured for vapour return. In certain embodiments, vapour return may not be required. During offloading, transfer hoses 250 may be disposed outboard of the carrier vessel 20 and hung in a catenary form. This way, less stress will be induced in the transfer hoses 250.

After the offloading operation is completed, various checks and procedures may take place to ensure that the hydrocarbon fluid transfer is ceased and it is safe to disconnect the transfer skid 200. The lifting system 400 may be deployed to connect to the transfer skid 200 in preparation to return the transfer skid 200 to the offshore platform 10 after the transfer skid 200 is disconnected from the carrier vessel 20. In one embodiment where the ERCs 216 has a dual function of a double block valve, after transfer pumps are stopped, the valves in the ERCs 216 may be closed and hydrocarbon fluid in the pipes 204 of the transfer skid 200 may be drained and purged towards the carrier vessel 20. After purging, the transfer skid 200 may be disconnected from the pipe deck 500. The transfer skid 200, supported by the lifting system 400, may be lifted away from the carrier vessel 20 and the carrier vessel 20 may then move off as and when required without waiting for hydrocarbon fluid remaining in the transfer hoses 250 to boil off and to be purged as required in conventional systems. Embodiments of the invention thus allow faster disconnection of the transfer skid 200 after an offloading operation is completed, and without waiting for hydrocarbon fluid in the transfer hoses 250 to boil off and to be purged before disconnecting the transfer skid 200 from the carrier vessel 20. In certain embodiments, the separate double block valves may be provided in the pipes 204 and may also be similarly utilized as described above.

Figure 17:
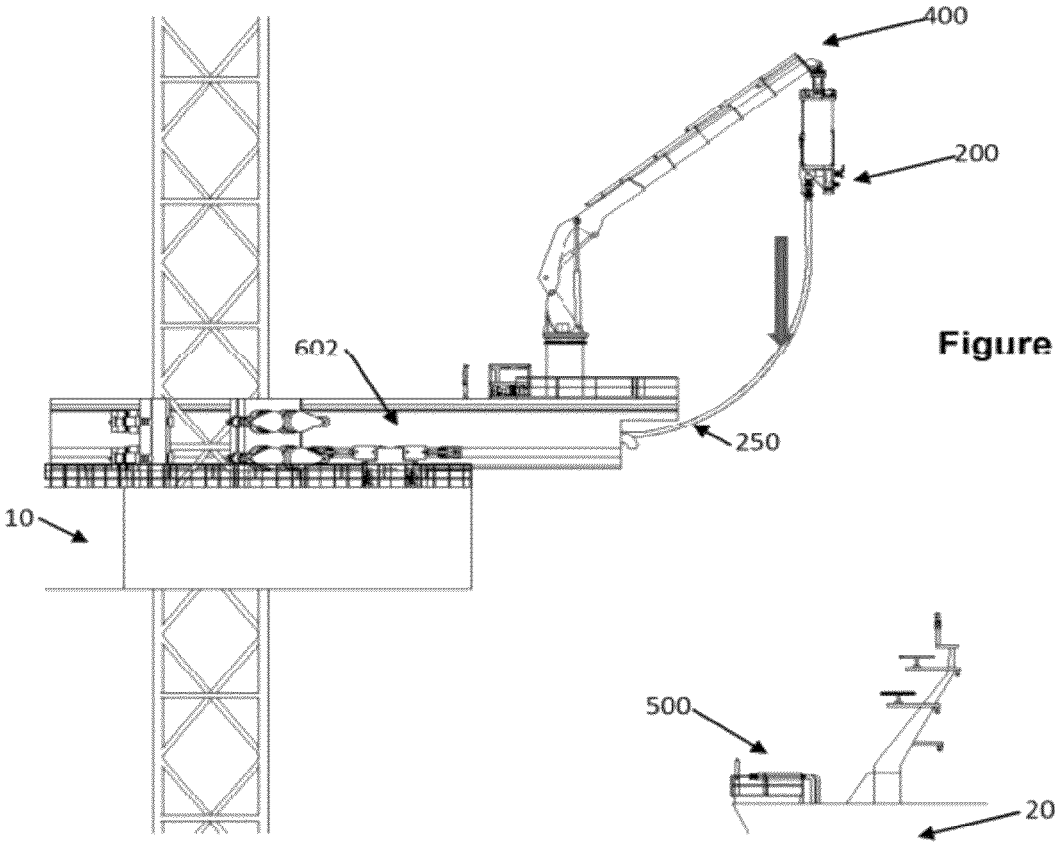
FIG. 17 illustrates a post-offloading arrangement.

The transfer skid 200, supported by the lifting system 400, is lifted to allow hydrocarbon fluid drain by gravity towards the mobile offloading platform 10 (see FIG. 17). Various checks and processes, e.g. purging, may take place to ensure all valves are sufficiently safe to be opened. The transfer skid 200 may be returned to the parking position on the mobile offloading platform 10.

Emergency Situation and Emergency Release Operation

During an offloading operation, an emergency situation may occur which requires the transfer hoses 250 to separate or disconnect from the carrier vessel 20 safely and quickly. Examples of an emergency situation include, but are not limited to, extreme weather, environmental conditions, failure of dynamic positioning system, failure of mooring lines, which cause the carrier vessel 20 to deviate from the desired position. Other examples include fire breakouts and explosion.

Once the operating conditions are ascertained to have exceeded certain safe operating threshold, an Emergency Shut Down situation may be triggered in which transfer pumps are stopped and an Emergency Release System may be subsequently triggered to disconnect the transfer hoses 250 from the transfer skid 200 installed at the carrier vessel 20. Particularly, the ERCs 216 are activated to detach the connector parts 216*a*, 216*b* forming the ERC 216 (see FIG. 18). Once disconnected, the detached part 216*a* of each ERC 216 will fall away from the transfer skid 200 due to gravity force. As the ERC 216 is arranged outboard of the carrier vessel 20, the detached part 216*a* of each ERC 216 is allowed to free-fall together with the corresponding transfer hose 250 attached thereto.

Figure 18:
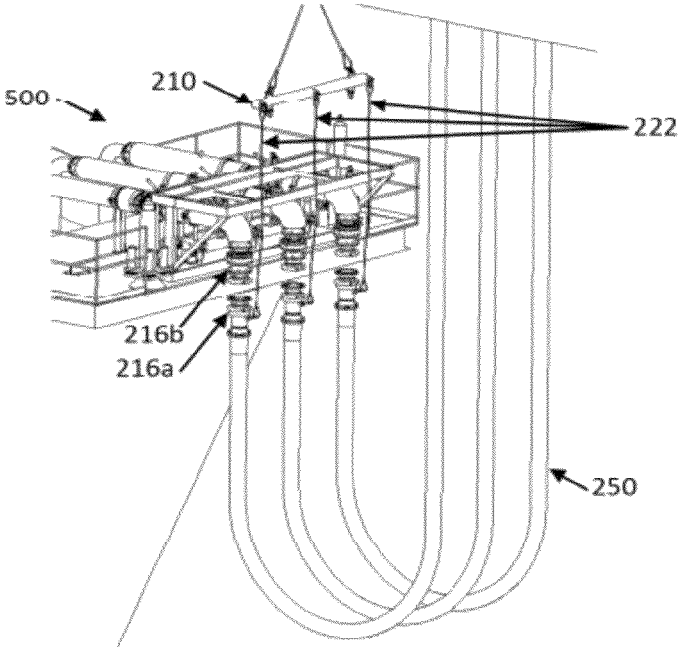
FIG. 18 illustrates detached ERCs during an emergency operation.
Figure 19:
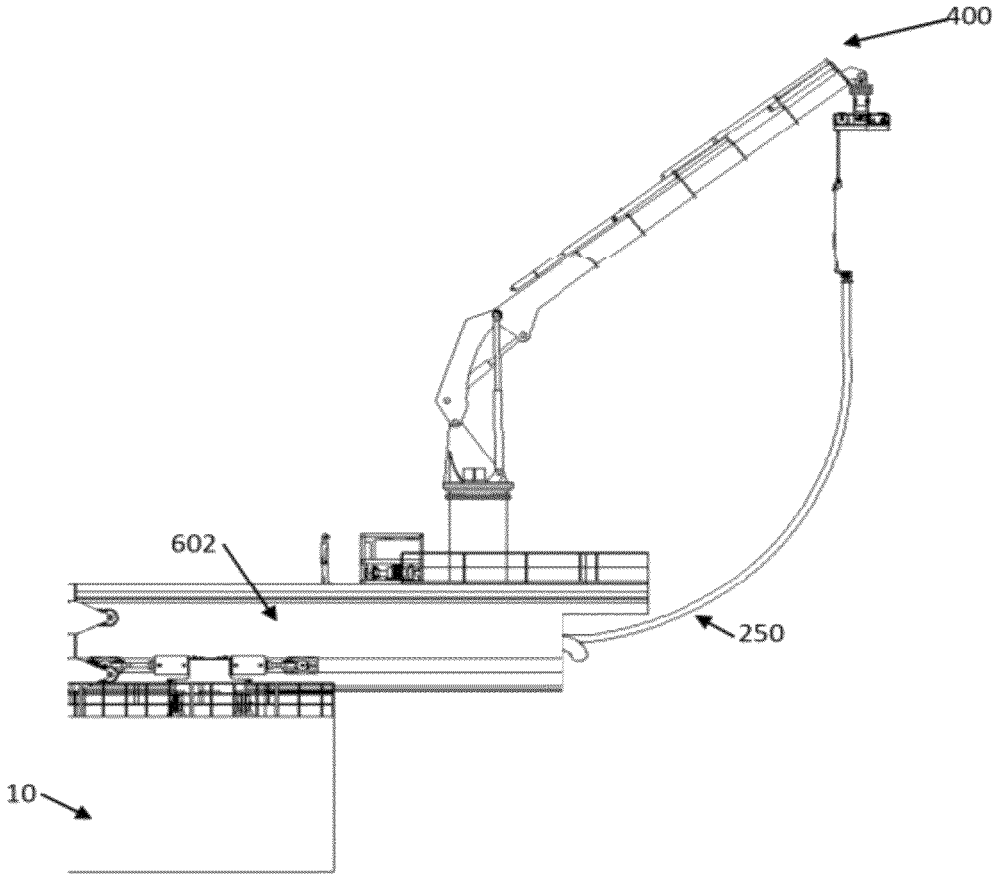
FIG. 19 illustrates the transfer hoses of FIG. 18 being drained of hydrocarbon fluid after an emergency release operation.

However, the fall of the detached part 216*a* of the ERC 216 may be limited by the second lifting device 440 of the lifting system 400, which supports the detached part 216*a* of the ERC. Particularly, as illustrated in FIG. 18, the detached part 216*a* of each ERC 216 is separately supported by an ERC hoist sling 222, which is attached to the spreader beam 210 which in turn remains supported by the second lifting device 440 provided on the spreader frame 420. Therefore, the fall of the detached part 216*a* of each ERC 216 is limited by the length of slack in the ERC hoist sling 222. Once the slack ERC hoist slings 222 become taut or fully extended, the detached part 216*a* of each ERC 216 is prevented from falling further. Draining and purging of the transfer hoses 250 may take place as a safety measure (see FIG. 19). Subsequently, the detached part 216*a* of the ERCs 216 and transfer hoses 250 are then returned to the mobile offloading platform 10 by the lifting devices 430, 440.

During the emergency release of the ERCs 216, the transfer skid 200, including pipes 204, QCDCs 212 and the other part 216*b* of the ERCs 216 which remains coupled to the QCDCs 212, will remain installed at the carrier vessel 20 until the emergency situation is brought under control or is resolved. Subsequently, a separate operation may be initiated to uninstall or disconnect the transfer skid 200 from the carrier vessel 20 and move or return the transfer skid 200 to the mobile offloading platform 10. Suitable procedures may take place to re-assemble the detached ERC parts 216*a*, 216*b* to prepare the transfer skid 200 for the next offloading operation.

Embodiments of the invention achieve various advantages such as but not limited to the following:

(1) During an offloading operation, the ERCs would be disposed outboard. If emergency release is required, the disconnected ERCs would free fall towards the sea and therefore would not result in hydrocarbon spill on the carrier vessel or collision with the carrier vessel.

(2) Although the transfer skid allow simultaneous transport of the multiple pipes and transfer hoses from a mobile offloading platform to a carrier vessel, each pipe of the transfer skid may be independently positioned and connected to the flanges of flexible expansion joints on the carrier vessel. This improves mating connection even if there is misalignment which may be due to various reasons, e.g. a deck of the carrier vessel supporting the pipe deck is uneven or tilted.

(3) The transfer skid supports multiple transfer devices so that transport of the transfer hoses together with the QCDCs and ERCs between two bodies is simultaneous and therefore efficient.

Other embodiments will be apparent to those skilled in the art from consideration of the specification and practice of the invention. Furthermore, certain terminology has been used for the purposes of descriptive clarity, and not to limit the disclosed embodiments of the invention. The embodiments and features described above should be considered exemplary, with the invention being defined by the appended claims.

The invention claimed is:

1. An offshore system for limiting structural damage to an affected offshore platform and preventing damage spread from the affected offshore platform to another platform during an accident or an emergency condition, comprising:

a mobile storage platform having a hydrocarbon storage facility;

a mobile offloading platform disposed at a first clearance distance from the mobile storage platform and having an offloading system for facilitating transfer of hydrocarbon fluid from the hydrocarbon storage facility to a carrier vessel which is positioned at the mobile offloading platform;

at least a first pipe connecting the mobile storage platform to the mobile offloading platform for allowing fluid communication of hydrocarbon fluid therebetween, wherein the at least first pipe is adapted to cease fluid communication of hydrocarbon fluid between the mobile storage platform and the mobile offloading platform;

a mobile offshore production unit (MOPU) having a production facility, wherein the mobile offshore production unit is disposed at a second clearance distance from the mobile storage platform; and at least a second pipe connecting the mobile offshore production unit to the mobile storage platform for allowing fluid communication of hydrocarbon fluid therebetween, wherein the at least second pipe is adapted to cease fluid communication of hydrocarbon fluid between the mobile offshore production unit and the mobile storage platform, wherein each of the mobile storage platform and the mobile offshore production unit includes a plurality of jack-up legs installed into a sea floor such that the mobile storage platform and the mobile offshore production unit are fixed bodies which are unaffected by wave motion, wherein the at least first pipe and the at least second pipe are located above the sea level, and wherein the mobile offloading platform includes a cantilever movably mounted on the mobile offloading platform for providing an adjustable horizontal clearance distance from an edge of the mobile offloading platform;

the offloading system disposed on the cantilever, which includes:

a transfer skid comprising:

a skid frame;

a plurality of pipes which are rigidly attached to the skid frame, plurality of jack screw mechanisms for independently adjusting the plurality of pipes relative to the skid frame, each of the plurality of pipes having a first end and a second distal end;

a coupler provided at the first end of the each of the plurality of pipes to connect to the carrier vessel after installing the transfer skid on the carrier vessel;

an emergency release coupling provided at the second end of the each of the plurality of pipes;

a transfer hose connected between the emergency release coupling and the mobile offloading platform; and a lifting system comprising:

an extendable lifting arm;

a spreader frame attachment rotatably coupled to the lifting arm, the spreader frame attachment includes at least a lifting device to support the transfer skid, and a powered rotator to rotate the spreader frame attachment about a tip of the extendable lifting arm to allow angular adjustment of the transfer skid in a horizontal plane.

2. The system of claim 1, wherein the hydrocarbon fluid is liquefied natural gas (LNG).

3. The system of claim 1, wherein the mobile storage platform further includes a production facility.

4. The system of claim 1, wherein the coupler is adapted to connect a pipe extension installed on the carrier vessel, wherein the pipe extension includes a flexible expansion joint which is deflectable in an axial direction, a lateral direction and an angular direction to align with the coupler.

5. The system of claim 4, wherein the coupler and the emergency release coupling are arranged spaced apart so that after installing the transfer skid onto the carrier vessel, the coupler is disposed inboard the carrier vessel while the emergency release coupling is disposed outboard of the carrier vessel.

6. The system of claim 5, wherein the emergency release coupling is adapted to disconnect the transfer hose from the transfer skid which is installed at the carrier vessel by way of detaching a part of the emergency release coupling, and to allow the detached part of the emergency release coupling, together with the transfer hose connected thereto, to fall away from the transfer skid due to gravity force, and wherein the detached part of the emergency release coupling is supported by the lifting system provided on the mobile offloading platform to limit the fall of the detached part of the emergency release coupling.

7. The system of claim 6, wherein each of the plurality of pipes is L-shaped.

8. The system of claim 1, wherein the mobile offloading platform includes a plurality of jack-up legs installed into a sea floor such that the mobile offloading platform is a fixed body which is unaffected by wave motion.

9. A method for limiting structural damage to an affected offshore platform and preventing damage spread from the affected offshore platform to another platform during an accident or an emergency condition, the method comprising:

disposing a mobile storage platform having a hydrocarbon storage facility at an offshore location, and having a plurality of jack-up legs installed into a sea floor such that the mobile storage platform is a fixed body which is unaffected by wave motion;

disposing a mobile offloading platform at a first clearance distance from the mobile storage platform, the mobile offloading platform having an offloading system for facilitating transfer of hydrocarbon fluid from the hydrocarbon storage facility to a carrier vessel which is positioned at the mobile offloading platform;

connecting the mobile storage platform to the mobile offloading platform using at least a first pipe for allowing fluid communication of hydrocarbon fluid therebetween, and locating the at least first pipe above the sea level;

providing at least a first block valve in the at least first pipe which is adapted to cease fluid communication of hydrocarbon fluid between the mobile storage platform and the mobile offloading platform;

disposing a mobile offshore production unit (MOPU), having a production facility, at a second clearance distance from the mobile storage platform, the mobile offshore production unit having a plurality of jack-up legs into a sea floor such that the mobile offshore production unit is a fixed body which is unaffected by wave motion;

connecting the mobile offshore production unit to the mobile storage platform using at least a second pipe for allowing fluid communication of hydrocarbon fluid therebetween, and locating the at least second pipe above the sea level;

providing at least a second block valve in the at least second pipe which is adapted to cease fluid communication of hydrocarbon fluid between the mobile offshore production unit and the mobile storage platform;

providing a cantilever movably mounted on the mobile offloading platform for providing an adjustable horizontal clearance distance from an edge of the mobile offloading platform; and disposing the offloading system on the cantilever, the offloading system including:

a transfer skid comprising:

a skid frame;

a plurality of pipes which are rigidly attached to the skid frame, a plurality of jack screw mechanisms for independently adjusting the plurality of pipes relative to the skid frame, each of the plurality of pipes having a first end and a second distal end;

a coupler provided at the first end of the each of the plurality of pipes to connect to the carrier vessel after installing the transfer skid on the carrier vessel;

an emergency release coupling provided at the second end of the each of the plurality of pipes;

a transfer hose connected between the emergency release coupling and the mobile offloading platform; and a lifting system comprising:

an extendable lifting arm;

a spreader frame attachment rotatably coupled to the lifting arm, the spreader frame attachment includes at least a lifting device to support the transfer skid, and a powered rotator to rotate the spreader frame attachment about a tip of the extendable lifting arm to allow angular adjustment of the transfer skid in a horizontal plane.

10. The method of claim 9, wherein the hydrocarbon fluid is liquefied natural gas (LNG).

11. The method of claim 9, wherein the coupler is adapted to connect a pipe extension installed on the carrier vessel, wherein the pipe extension includes a flexible expansion joint which is deflectable in an axial direction, a lateral direction and an angular direction to align with the coupler.

12. The method of claim 11, wherein the coupler and the emergency release coupling are arranged spaced apart so that after installing the transfer skid onto the carrier vessel, the coupler is disposed inboard the carrier vessel while the emergency release coupling is disposed outboard of the carrier vessel.

13. The method of claim 12, wherein the emergency release coupling is adapted to disconnect the transfer hose from the transfer skid which is installed at the carrier vessel by way of detaching a part of the emergency release coupling, and to allow the detached part of the emergency release coupling, together with the transfer hose connected thereto, to fall away from the transfer skid due to gravity force, and wherein the detached part of the emergency release coupling is supported by the lifting system provided on the mobile offloading platform to limit the fall of the detached part of the emergency release coupling.

14. The method of claim 9, wherein the mobile offloading platform includes a plurality of jack-up legs installed into a sea floor such that the mobile offloading platform is a fixed body which is unaffected by wave motion.

* * * * *